US006284441B1

(12) United States Patent
Burberry

(10) Patent No.: US 6,284,441 B1
(45) Date of Patent: Sep. 4, 2001

(54) PROCESS FOR FORMING AN ABLATION IMAGE

(75) Inventor: Mitchell Burberry, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/515,146

(22) Filed: Feb. 29, 2000

(51) Int. Cl.[7] ..... G03C 5/16
(52) U.S. Cl. ..... 430/346; 430/292; 430/945
(58) Field of Search ..... 430/292, 201, 430/945, 346

(56) References Cited

U.S. PATENT DOCUMENTS 5,171,650 12/1992 Ellis et al. .
5,256,506 * 10/1993 Ellis et al. ..... 430/20
5,354,633 * 10/1994 Lewis et al. ..... 430/5
5,468,591 11/1995 Pearce et al. .
5,503,956 * 4/1996 Kaszczuk et al. ..... 430/200
5,529,884 * 6/1996 Tutt et al. ..... 430/269
5,569,568 * 10/1996 DeBoer ..... 430/5
5,654,079 * 8/1997 Tutt et al. ..... 428/195
5,742,401 * 4/1998 Bringley et al. ..... 358/297

* cited by examiner

*Primary Examiner*—John A. McPherson
(74) *Attorney, Agent, or Firm*—Harold E. Cole

(57) ABSTRACT

A process of forming a single color, ablation image comprising imagewise heating by means of a laser in the absence of a separate receiving element, an ablative recording element comprising a support having thereon, in order, a barrier layer and a colorant layer comprising a colorant dispersed in a polymeric binder, the colorant layer having an infrared-absorbing material associated therewith, the laser exposure taking place through the colorant side of the element, and removing the ablated colorant to obtain the image in the ablative recording element, wherein the barrier layer comprises a thin metal film having a UV optical density up to about 3.0.

7 Claims, No Drawings

PROCESS FOR FORMING AN ABLATION IMAGE

CROSS REFERENCE TO RELATED APPLICATION

Reference is made to commonly-assigned, copending U.S. patent application Ser. No. 09/515,149, filed of even date herewith, entitled "Process for Forming an Ablation Image", by Burberry et al., the disclosure of which is hereby incorporated by reference.

FIELD OF THE INVENTION

This invention relates to a process of forming an ablation image using, a barrier layer in a laser ablative recording element.

BACKGROUND OF THE INVENTION

In recent years, thermal transfer systems have been developed to obtain prints from pictures which have been generated electronically from a color video camera. Accordingly to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing, head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,1271, the disclosure of which is hereby incorporated by reference.

Another way to thermally obtain a print using the electronic signals described above is to use a laser instead of a thermal printing, head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

In one ablative mode of imaging by the action of a laser beam, an element with a dye layer composition comprising an image dye, an infrared-absorbing material, and a binder coated onto a substrate is imaged from the dye side. The energy provided by the laser drives off substantially all of the image dye and binder at the spot where the laser beam hits the element. In ablative imaging, the laser radiation causes rapid local changes in the imaging layer thereby causing the material to be ejected from the layer. The transmission density serves as a measure of the completeness of image dye removal by the laser.

U.S. Pat. No. 5,468,591 relates to a barrier layer, such as a vinyl polymer and an IR-dye, for laser ablative imaging. There is a problem with that barrier layer, however, in that the imaging efficiency is not as high as one would like.

U.S. Pat. No. 5,171,650 relates to an ablation-transfer image recording process. In that process, an element is employed which contains a dynamic release layer which absorbs imaging radiation which in turn is overcoated with an ablative carrier topcoat. Examples of the dynamic release layer include thin films of metals. An image is transferred to a receiver in contiguous registration therewith. However, there is a problem with this process in that it requires a separate receiving element which is more expensive.

It is an object of this invention to provide a single-sheet process of forming a single color, ablation image which does not require a separate receiving element. It is still another object of this invention to provide a single-sheet process of forming a single color, ablation image which has improved efficiency.

SUMMARY OF THE INVENTION

These and other objects are achieved in accordance with the invention which comprises a process of forming a single color, ablation image comprising imagewise heating by means of a laser in the absence of a separate receiving element, an ablative recording element comprising a support having thereon, in order, a barrier layer and a colorant layer comprising a colorant dispersed in a polymeric binder, the colorant layer having an infrared-absorbing material associated therewith, the laser exposure taking place through the colorant side of the element and removing the ablated colorant to obtain the image in the ablative recording element, wherein the barrier layer comprises a thin metal film having a UV optical density up to about 3.0.

By use of the invention, a more scratch-resistant element is obtained that has a practical Dmax and exposure level, i.e., greater efficiency, than the prior art.

DETAILED DESCRIPTION OF THE INVENTION

In a preferred embodiment of the invention, the metal is a transition metal or a group III, group IV or group V metal. In another preferred embodiment, the metal is titanium, nickel or iron.

While any coverage of the thin metal barrier layer may be employed which is effective for the intended purpose, good results have been obtained at a thickness of from about 500 Å to about 5,000 Å.

The ablation elements of this invention can be used to obtain medical images, reprographic masks, printing masks, etc. The image obtained can be a positive or a negative image.

The invention is especially useful in making reprographic masks which are used in publishing and in the generation of printed circuit boards. The masks are placed over a photosensitive material, such as a printing plate, and exposed to a light source. The photosensitive material usually is activated only by certain wavelengths. For example, the photosensitive material can be a polymer which is crosslinked or hardened upon exposure to ultraviolet or blue light but is not affected by red or green light. For these photosensitive materials, the mask, which is used to block light during exposure, must absorb all wavelengths which activate the photosensitive material in the Dmax regions and absorb little in the Dmin regions. For printing plates, it is therefore important that the mask have high UV Dmax. If it does not do this, the printing plate would not be developable to give regions which take up ink and regions which do not.

The dye removal process can be by either continuous (photographic-like) or halftone imaging methods.

The higher efficiency achieved in accordance with the invention greatly expands the UV contrast of these ablative elements, which enhances their usefulness when exposing UV-sensitive printing plates with UV radiation.

Any polymeric material may be used as the binder in the recording element employed in the process of the invention. For example, there may be used cellulosic derivatives, e.g., cellulose nitrate, cellulose acetate hydrogen phthalate, cellulose acetate, cellulose acetate propionate, cellulose acetate butyrate, cellulose triacetate, a hydroxypropyl cellulose ether, an ethyl cellulose ether, etc., polycarbonates; polyurethanes; polyesters; poly(vinyl acetate); poly(vinyl halides) such as poly(vinyl chloride) and poly(vinyl chloride) copolymers; poly(vinyl ethers); maleic anhydride copolymers; polystyrene; poly(styrene-co-acrylonitrile); a polysulfone; a poly(phenylene oxide); a poly(ethylene oxide); a poly(vinyl alcohol-co-acetal) such as poly(vinyl acetal), poly(vinyl alcohol-co-butyral) or poly(vinyl benzal); or mixtures or copolymers thereof. The binder may be used at a coverage of from about 0.1 to about 5 $g/m^2$.

In a preferred embodiment, the polymeric binder used in the recording element employed in process of the invention has a polystyrene equivalent molecular weight of at least 100,000 as measured by size exclusion chromatography, as described in U.S. Pat. 5,330,876.

The colorant layer of the invention may also contain a hardener to crosslink the polymeric binder or react with itself to form a interpenetrating network. Examples of hardeners that can be employed in the invention fall into several different classes such as the following (including mixtures thereof):

a) formaldehyde and compounds that contain two or more aldehyde functional groups such as the homologous series of dialdehydes ranging from glyoxal to adipaldehyde including succinaldehyde and glutaraldehyde; diglycolaldehyde; aromatic dialdehydes, etc.;

b) blocked hardeners (substances usually derived from the active hardener that release the active compound under appropriate conditions) such as substances that contain blocked aldehyde functional groups, such as tetrahydro-4-hydroxy-5-methyl-2(1H)-pyrimidinone polymers, polymers of the type having a glyoxal polyol reaction product consisting of 1 anhydroglucose unit: 2 glyoxal units, dimethoxylethanal-melamine non-formaldehyde resins, 2,3-dihydroxy-1,4-dioxane, blocked dialdehydes and N-methylol compounds obtained from the condensation of formaldehyde with various aliphatic or cyclic amides, ureas, and nitrogen heterocycles;

c) active olefinic compounds having two or more olefinic bonds, especially unsubstituted vinyl groups, activated by adjacent electron withdrawing groups, such as divinyl ketone; resorcinol bis(vinylsulfonate); 4,6-bis(vinylsulfonyl)-m-xylene; bis(vinylsulfonylalkyl) ethers and amines; 1,3,5-tris(vinylsulfonyl) hexahydro-s-triazine; diacrylamide; 1,3-bis(acryloyl)urea; N,N'-bismaleimides; bisisomaleimides; bis(2-acetoxyethyl) ketone; 1,3,5-triacryloylhexahydro-s-triazine; and blocked active olefins of the type bis(2-acetoxyethyl) ketone and 3,8-dioxodecane-1,10-bis(pyridinium perchlorate) bis(vinyl sulfonylmethane), bis(vinyl sulfonylmethyl ether), and the like;

d) compounds that contain two or more amino groups such as ethylene diamine; and e) inorganic salts such as aluminum sulfate; potassium and ammonium alums of aluminum; ammonium zirconium carbonate; chromium salts such as chromium sulfate and chromium alum, and salts of titanium dioxide, zirconium dioxide, etc.

In a preferred embodiment, the hardner is a diisocyanate, such as a homopolymer of 1,6-hexamethylene diisocyanate, N-(4-((2-hydroxy-5-methylphenyl)azo)-1-naphthyl)azo)-1H-perimidine). The hardener may be used in any amount effective for the intended purpose. In general, it may be used from about 0.1% to about 25% by weight of the polymeric binder.

To obtain a laser-induced, ablative image using the process of the invention, a diode laser is preferably employed since it offers substantial advantages in terms of its small size, low cost, stability, reliability, ruggedness, and ease of modulation. In practice, before any laser can be used to heat a ablative recording element, the element must contain an infrared-absorbing material, such as pigments like carbon black, or cyanine infrared-absorbing dyes as described in U.S. Pat. No. 4,973,572, or other materials as described in the following U.S. Pat. Nos. 4,948,777, 4,950,640, 4,950,639, 4,948,776, 4,948,778, 4,942,141, 4,952,552, 5,036,040, and 4,912,083, the disclosures of which are hereby incorporated by reference. The laser radiation is then absorbed into the colorant layer and converted to heat by a molecular process known as internal conversion. Thus, the construction of a useful colorant layer will depend not only on the hue, transferability and intensity of the colorant, but also on the ability of the colorant layer to absorb the radiation and convert it to heat. The infrared-absorbing material or dye may be contained in the colorant layer itself or in a separate layer associated therewith, i.e., above or below the colorant layer. As noted above, the laser exposure in the process of the invention takes place through the colorant side of the ablative recording element, which enables this process to be a single-sheet process, i.e., a separate receiving element is not required.

Lasers which can be used in the invention are available commercially. There can be employed, for example, Laser Model SDL-2420-H2 from Spectra Diode Labs, or Laser Model SLD 304 V/W from Sony Corp.

Any dye can be used in the ablative recording element employed in the invention provided it can be ablated by the action of the laser. Especially good results have been obtained with dyes such as anthraquinone dyes, e.g., Sumikaron Violet RS® (product of Sumitomo Chemical Co., Ltd.), Dianix Fast Violet 3R-FS(® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5G® (g (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., ILtd.), and Aizen Malachite Green® (product of Hodogaya Chemical Co., Ltd.);

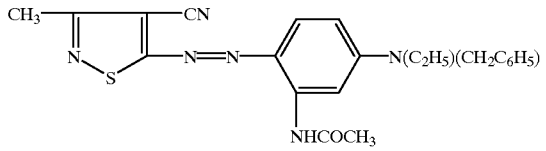

(magenta)

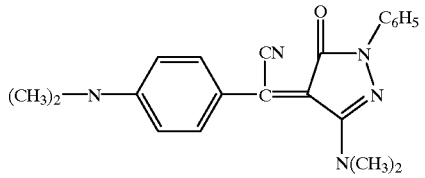

(magenta)

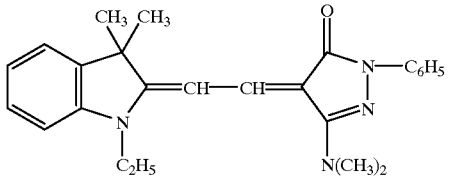

(yellow)

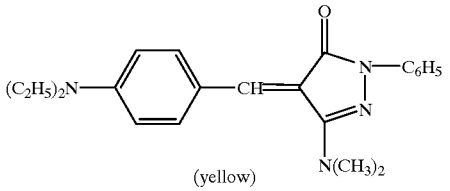

(yellow)

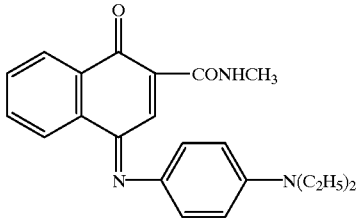

(cyan)

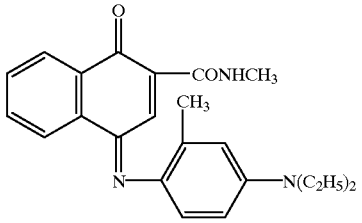

(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

Pigments which may be used in the colorant layer of the ablative recording layer of the invention include carbon black, graphite, metal phthalocyanines, etc. When a pigment is used in the colorant layer, it may also function as the infrared-absorbing material, so that a separate infrared-absorbing material does not have to be used.

The colorant layer of the ablative recording element employed in the invention may be coated on the support or printed thereon by a printing technique such as a gravure process.

Any material can be used as the support for the ablative recording element employed in the invention provided it is dimensionally stable and can withstand the heat of the laser. Such materials include polyesters such as poly(ethylene naphthalate); poly(ethylene terephthalate); polyamides; polycarbonates; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about to about 200 $\mu$m. In a preferred embodiment, the support is transparent.

The following examples are provided to illustrate the invention.

EXAMPLES

Example 1

The following dyes were used in this Example:

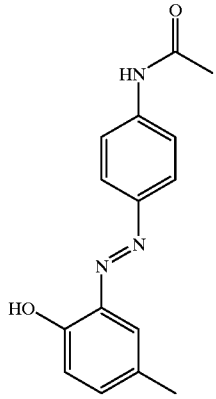

UV Dye

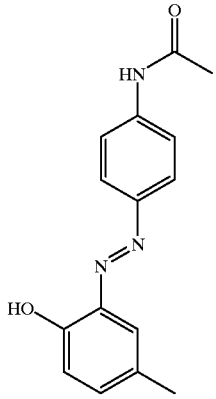

Yellow Dye

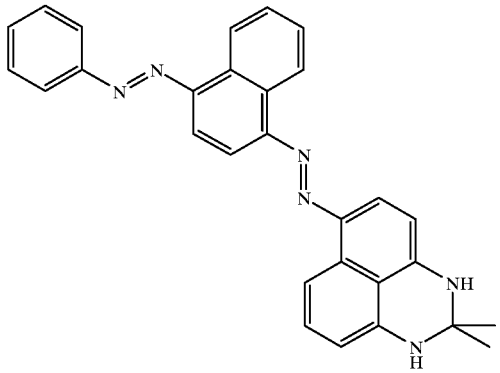

Cyan Dye

-continued

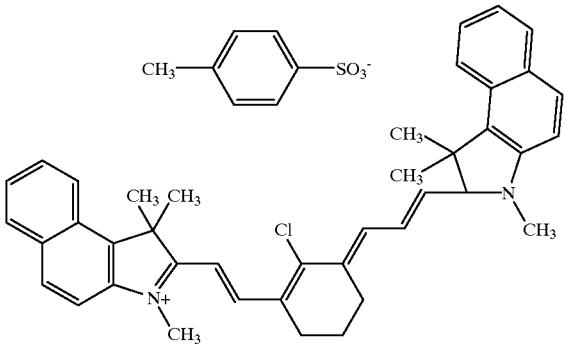

IR Dye-1

Control Element 1 (Polycvanoacrylate barrier layer)

A 100 μm poly(cthylene terephthalate) support was coated with a barrier layer containing the following ingredients at the indicated aim dry coverages: 0.38 g/m$^2$ poly(methyl 2-cyanoacrylate), 0.05 g/m$^2$ IR Dye-1, and 0.003 g/m$^2$ surfactant FC-431® (3M Corp.) from acetonitrile.

On top of the barrier layer was coated an image layer from a methyl isobutyl ketone/ethanol 8:2 solvent mixture at a wet laydown of 32 cc/m$^2$ containing the following dissolved ingredients at the indicated aim dry coverages:

0.60 g/m$^2$ Cellulose nitrate (1000–15000 cps) (Aqualon Co.)

0.28 g/m$^2$ UV Dye 0.13 g/m$^2$ of Yellow Dye 0.16 g/m$^2$ Cyan Dye 0.22 g/m$^2$ IR Dye-1

Elements 1–5 of the Invention (Metal barrier layer)

These elements were prepared the same as Control 1 except that the barrier layer was various metals as shown in Table 1 which were deposited by vacuum deposition. Prior to vacuum deposition, the substrate was coated with a subbing layer of poly(acrylonitrile-co-vinylidene chloride-co-acrylic acid) (14:79:7 wt. ratio (0.05 g/m$^2$).

The amount of metal barrier layer was measured by UV optical density as reported in Table 1.

The elements were then coated with the same image layer as in Control 1. The image layer was adjusted to make the total UV (image layer plus barrier layer) density fall approximately in the range between 3.5 and about 4.2.

Comparative Element 1

This element was the same as Element 4 except that the amount of nickel deposited gave an optical density of greater than 3.0.

Imaging

The above recording elements were imaged with a diode laser imaging device as described in U.S. Pat. No. 5,387,496. The laser beam had a wavelength of 830 nm and a nominal power output of 450 m Watts per channel at the end of the optical fiber. Table 1 lists UV transmission density recorded on an X-Rite® densitometer Model 310 (X-Rite Co.). The exposure needed to obtain a UV density equal to 0.1 o.d. is reported in Table 1. Lower values indicate more efficient, i.e. faster, imaging. A missing number implies that a Dmin value as low as 0.1 o.d. was not achieved.

Scratch Test

Unexposed samples were subjected to surface abrasion with a counterweighted rotating disk and turntable arrangement for a fixed time interval. The UV density of the abraded area (Dscratch) and unabraded area (Dmax) were measured. Scratch is reported as "% Area Lost" calculated using a form of the Murray-Davies equation:

$$\%\ \text{Area Lost}=100-\%\ \text{Area Retained}=100(1-(1-10^{-D_{scratch}})/(1-10^{-D_{max}})).$$

The scratch testing is subject to high noise levels. The data reported are derived from averages of eight readings per sample. The following results were obtained:

TABLE 1

Metal Barrier Layer

| Element | Metal | Barrier UV Density | Total UV Density | Exposure* Limit (mJ/cm$^2$) | % Area Lost to Scratch |
|---|---|---|---|---|---|
| 1 | Fe | 1.87 | 3.58 | 506 | 0.15 |
| 2 | Ti | 2.38 | 4.18 | 414 | 0.35 |
| 3 | Ti | 1.05 | 3.80 | 380 | 0.06 |
| 4 | Ni | 0.75 | 3.79 | 414 | 0.47 |
| 5 | Ni | 0.33 | 3.61 | 380 | 0.61 |
| Comp. 1 | Ni | 3.53 | 4.59 | ** | 0.02 |
| Control 1 | *** | — | 3.85 | 450 | 0.80 |

*Exposure needed to achieve 0.1 UV density.
**Dmin was greater than 0.1 o.d. (i.e., too slow for practical application)
***Barrier layer was polycyanoacrylate and IR-dye The above results show that the elements of the invention had a lower % area lost to scratch than Control 1. The comparative element 1 which had a thicker nickel layer to give an optical density of 3.53, which is outside the range claimed, was so inefficient that it did not reach the 0.1 Dmin level.

Example 2 (Hardened Image Layers)

Element 6

This element was prepared the same as Element 3 above except that the image layer contained 4% by wt. of the coating solution of a diisocyanate hardener (a homopolymer of 1,6-hexamethylene diisocyanate, N-(4-((2-hydroxy-5-methylphenyl)azo)-1-naphthyl)azo)-1H-perimidine).

Control 2

This clement was prepared the same as Control 1 above except that the image layer contained 4% by wt. of the coating solution of a diisocyanate hardener (a homopolymer of 1,6-hexamethylene diisocyanate, N-(4-((2-hydroxy-5-methylphenyl)azo)-1-naphthyl)azo)-1H-perimidine).

The above elements were exposed and tested as in Example 1. The following results were obtained:

TABLE 2

Hardened Image Layer

| Element | Barrier | Barrier UV Density | Total UV Density | Dmin @ 490 mJ/cm$^2$ (o.d.) | % Area Lost to Scratch |
|---|---|---|---|---|---|
| 6 | Ti | 1.05 | 3.93 | 0.11 | 0.01 |
| Control 2 | * | — | 3.63 | 0.48 | 0.20 |

*Barrier layer was polycyanoacrylate and IR-dye

The above results show that the element of the invention had a lower % area lost to scratch than Control 2 and had lower Dmin, indicating that it was faster.

The invention has been described in detail with particular reference to preferred embodiments thereof, but it will be understood that variations and modifications can be effected within the spirit and scope of the invention.

What is claimed is:

1. A process of forming a single color, ablation image comprising imagewise heating by means of a laser in the absence of a separate receiving element, an ablative recording element comprising a support having thereon, in order, a baiter layer and a single colorant layer comprising a dye dispersed in a polymeric binder, an infrared-absorbing material and a hardener, said laser exposure taking place through the colorant side of said element, and removing the ablated colorant to obtain said image in said ablative recording element, wherein said barrier layer comprises a thin metal film having a UV optical density up to about 3.0.

2. The process of claim 1 wherein said metal is a transition metal or a group III, group IV or group V metal.

3. The process of claim 1 wherein said metal is titanium, nickel or iron.

4. The process of claim 1 wherein said infrared-absorbing material is a dye.

5. The process of claim 1 wherein said support is transparent.

6. The process of claim 1 wherein said polymeric binder comprises cellulose nitrate.

7. The process of claim 1 wherein said hardener is a diisocyanate.

* * * * *